US007679470B2

(12) United States Patent
Kawanami et al.

(10) Patent No.: US 7,679,470 B2
(45) Date of Patent: Mar. 16, 2010

(54) NONRECIPROCAL CIRCUIT DEVICE

(75) Inventors: Takashi Kawanami, Oumihachiman (JP); Reiji Nakajima, Komatsu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/434,767

(22) Filed: May 4, 2009

(65) Prior Publication Data

US 2009/0206943 A1 Aug. 20, 2009

Related U.S. Application Data

(63) Continuation of application No. PCT/JP2008/060538, filed on Jun. 9, 2008.

(30) Foreign Application Priority Data

Jun. 22, 2007 (JP) ..... 2007-164477

(51) Int. Cl.
*H01P 1/36* (2006.01)

(52) U.S. Cl. ..... 333/24.2

(58) Field of Classification Search ..... 333/1.1, 333/24.2

See application file for complete search history.

(56) References Cited

U.S. PATENT DOCUMENTS 6,982,608 B2 * 1/2006 Shibayama ..... 333/24.2
2007/0236304 A1 10/2007 Kawanami

FOREIGN PATENT DOCUMENTS

JP 2004-88743 A 3/2004
JP 2006-157094 A 6/2006

OTHER PUBLICATIONS

Official Communication issued in International Patent Application No. PCT/JP2008/060538, mailed on Aug. 26, 2008.

* cited by examiner

*Primary Examiner*—Stephen E Jones
(74) *Attorney, Agent, or Firm*—Keating & Bennett, LLP

(57) ABSTRACT

A nonreciprocal circuit device includes a permanent magnet, a ferrite to which the permanent magnet applies a direct-current magnetic field, first and second central electrodes arranged on the ferrite, and a circuit board. The first central electrode includes electrode layers provided on main surfaces of the ferrite connected by an electrode provided on a top surface of the ferrite. A second central electrode includes electrode layers provided on the main surfaces of the ferrite connected by electrodes arranged on top and bottom surfaces of the ferrite. The second electrode is wound at least about three turns around the ferrite. A width dimension of the outermost electrode layers of the second central electrode is greater than a width dimension of the inner electrode layers of the second central electrode.

5 Claims, 7 Drawing Sheets

NONRECIPROCAL CIRCUIT DEVICE

BACKGROUND OF THE INVENTION

1. Field of the Invention

The present invention relates to a nonreciprocal circuit device and, in particular, to a nonreciprocal circuit device such as an isolator or a circulator used in microwave bands.

2. Description of the Related Art

A nonreciprocal circuit device, such as an isolator or a circulator, has known characteristics that transmit a signal only in a predetermined direction and not in a reverse direction. Because of these characteristics, for example, the isolator is used in a transmitter circuit of a mobile communication device, such as an automobile telephone or a cellular phone, for example.

A 2-port isolator is described as a known nonreciprocal circuit device in International Publication No. 2007/046229. In the 2-port isolator, a first central electrode is wound by one turn around a rectangular parallelepiped ferrite and a second central electrode is wound by a plurality of turns around the ferrite such that the second central electrode crosses the first central electrode at a predetermined angle therebetween and is insulated from the first central electrode.

In the 2-port isolator, the first and second central electrodes are defined by an electrode layer on the surface of the ferrite. When the second central electrode is wound by a plurality of turns, a predetermined spacing S must be allowed with respect to line width L of the electrode layer. The line width L of the electrode layer cannot be increased. More specifically, if the line width of the second central electrode is decreased, resistance thereof increases, Q of the second central electrode decreases, and an insertion loss is increased accordingly.

For example, if a winding pitch is 100 μm, a spacing S of 30 μm is required, and the line width L has a maximum value of 70 μm. Due to the generation of insulation breakdown caused by a print smudge of the electrode layer, a solvent remnant in a photolithographic process, and diffusion into an insulator, the spacing S must be at least 30 μm. In other words, in the known 2-port type isolator including the electrode layer defining the second central electrode wound around the ferrite by a plurality of turns, the line width of the second central electrode is relatively small, and the improvement of the insertion loss of the 2-port type isolator is limited.

On the other hand, Japanese Unexamined Patent Application Publication No. 2006-157094 discloses a 2-port type isolator in which a ferrite is arranged in a horizontal position with a circuit board (with a main surface of the ferrite arranged in parallel with the surface of the circuit board). In the 2-port type isolator, a first central electrode and a second central electrode are arranged on the main surface of the ferrite so as to cross each other in an insulated state, and a line width of each central electrode on the portion thereof other than a crossing section is set to be different from a line width of the crossing section in order to adjust impedance of the isolator. In this 2-port type isolator, however, no consideration is given to decreasing the insertion loss by increasing Q of the second central electrode.

SUMMARY OF THE INVENTION

To overcome the problems described above, preferred embodiments of the present invention provide a nonreciprocal circuit device that reduces an insertion loss and increases the Q value of a second central electrode.

A nonreciprocal circuit device according to a preferred embodiment of the present invention includes a permanent magnet, a ferrite to which the permanent magnet applies a direct-current magnetic field, a first central electrode arranged on the ferrite and having one end thereof electrically connected to an input port and the other end thereof electrically connected to an output port, a second central electrode arranged on the ferrite, crossing the first central electrode in an electrically insulated state from the first central electrode, and having one end thereof electrically connected to the output port and the other end thereof electrically connected to a ground port, a first matching capacitor electrically connected between the input port and the output port, a resistor electrically connected between the input port and the output port, a second matching capacitor electrically connected between the output port and the ground port, and a circuit board having a terminal electrode provided on the surface thereof. The ferrite has a substantially rectangular parallelepiped shape. The first central electrode includes electrode layers provided on a pair of main surfaces of the ferrite and connected to each other by an electrode arranged on a side surface of the ferrite that is continuous with the main surfaces of the ferrite. The second central electrode includes electrode layers provided on the pair of main surfaces of the ferrite and connected to each other by an electrode arranged on the side surface of the ferrite continuous with the main surfaces of the ferrite, the second electrode is wound at least about three turns around the ferrite, a width dimension of the electrode layer wound as the outermost winding of the second central electrode is greater than a width dimension of the electrode layer wound as an inner winding of the second central electrode.

The nonreciprocal circuit device is preferably a 2-port type lumped constant isolator having an intrinsically small insertion loss with the first central electrode and the second central electrode arranged to cross each other on a substantially rectangular parallelepiped ferrite in an electrically insulated state from each other. In particular, the second central electrode is provided by winding the electrode layer around the ferrite by at least about three turns. The width dimension of the electrode layer wound as the outermost winding of the second central electrode is set to be greater than the width dimension of the electrode layer wound as the inner winding of the second central electrode. This arrangement increases the Q of the second central electrode, thereby leading to a reduced insertion loss.

The electrode layer of the second central electrode wound as the outermost winding of the second central electrode preferably expands outwardly. The width dimension of the electrode layer is increased at a high space efficiency without damaging the insulation.

The main surface of the ferrite may preferably be arranged to be perpendicular or substantially perpendicular to the surface of the circuit board. In this case, a ferrite-magnet assembly is preferably constructed by sandwiching the ferrite on the main surfaces thereof between a pair of magnets. Since a parallel magnetic field distribution is provided, a miniaturized nonreciprocal circuit device having a high magnetic efficiency can be produced.

Preferably, the circuit board includes at least the first matching capacitor and the second matching capacitor. The circuit is thus miniaturized, and the nonreciprocal circuit device is also miniaturized.

Thus, various preferred embodiments of the present invention provide a nonreciprocal circuit device with an increased Q value of a second central electrode and a reduced insertion loss.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Nonreciprocal circuit devices according to preferred embodiments of the present invention are described below with reference to the accompanying drawings.

Figure 1:
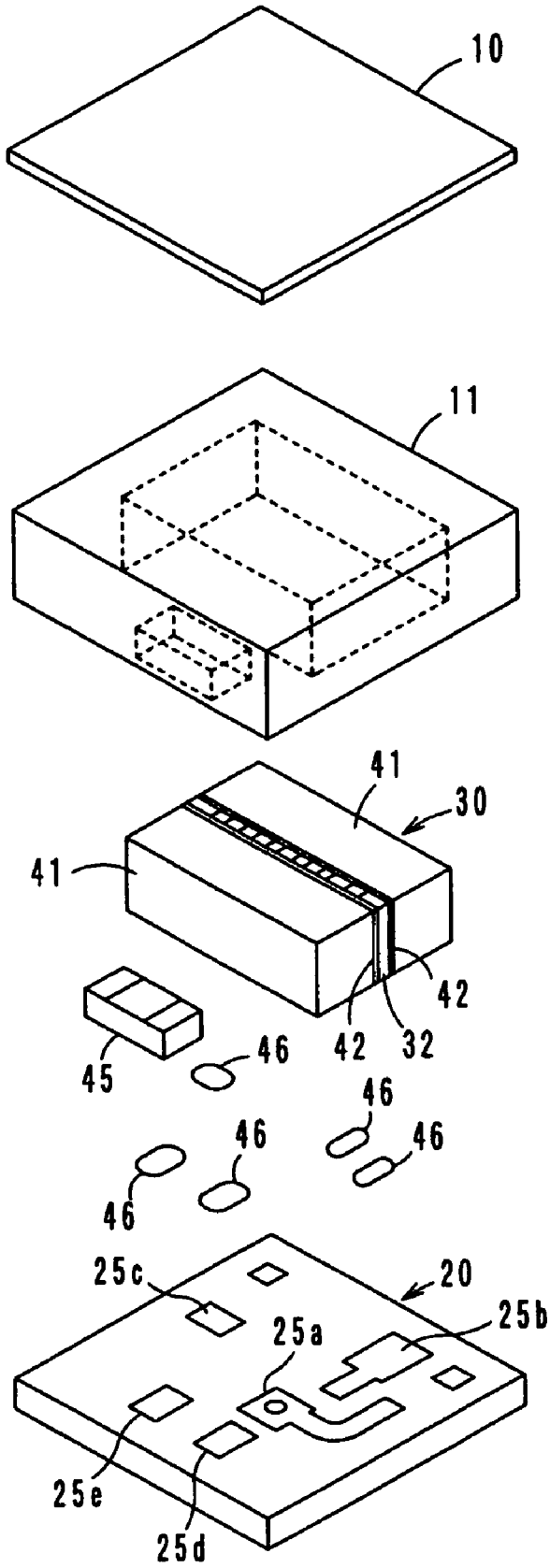
FIG. 1 is a perspective view illustrating a nonreciprocal circuit device in accordance with a preferred embodiment of the present invention.

FIG. 1 is an exploded perspective view of a 2-port type isolator as an example of the nonreciprocal circuit device according to a preferred embodiment of the present invention. The 2-port type isolator is a lumped constant type isolator, and includes a ferrite-magnet assembly 30 primarily including a plate yoke 10 which defines a shield member, a sealing resin 11, a circuit board 20, a ferrite 32, and permanent magnets 41. FIG. 1 further shows a chip resistor 45 and connection solder 46, defining a circuit to be discussed below.

With reference to FIGS. 2 and 4A to 4E, a first central electrode 35 and a second central electrode 36, electrically insulated from each other, are provided on front and back main surfaces 32*a* and 32*b* of the ferrite 32. Here, the ferrite 32 has a substantially rectangular parallelepiped shape having the first main surface 32*a* and the second main surface 32*b* that are parallel or substantially to each other.

Figure 2:
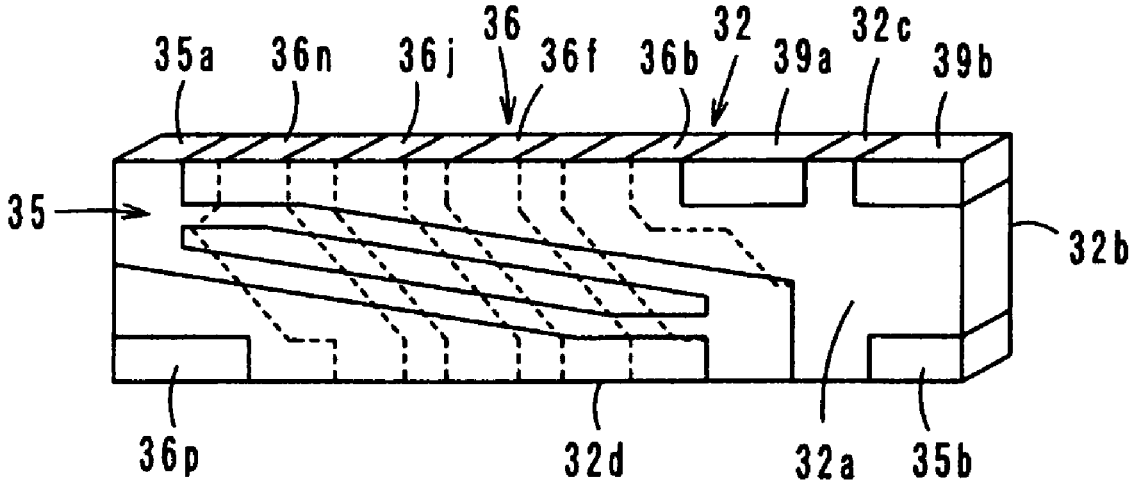
FIG. 2 is a perspective view illustrating a ferrite with a central electrode.
Figure 4A:
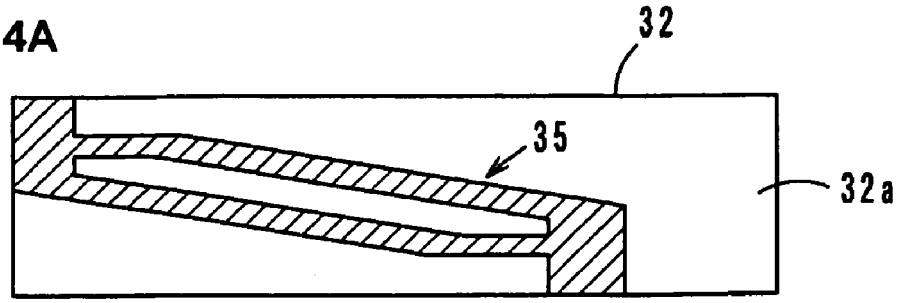
FIGS. 4A to 4E illustrate the central electrode provided on a main surface of the ferrite.
Figure 4B:
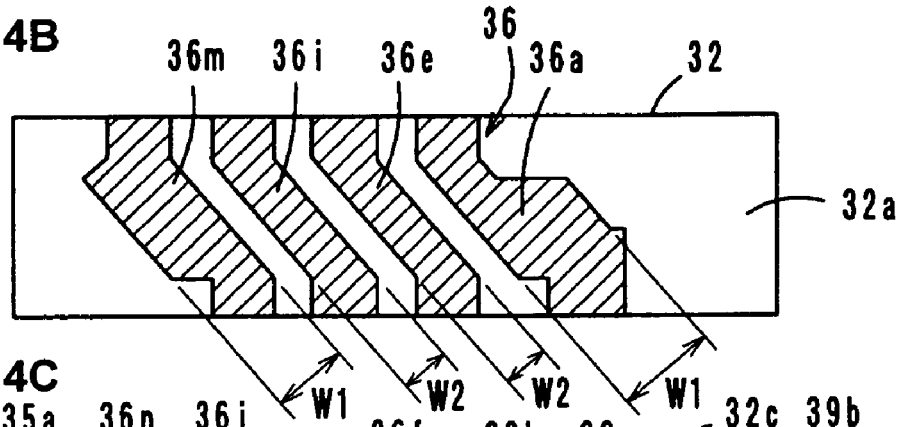
Figure 4C:
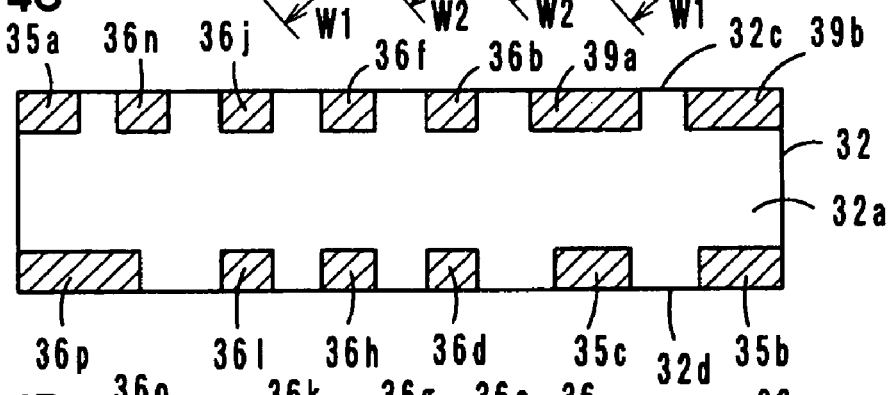
Figure 4D:
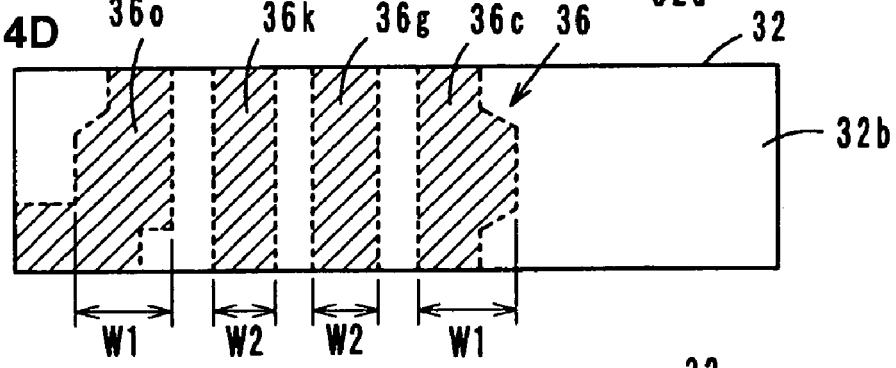
Figure 4E:
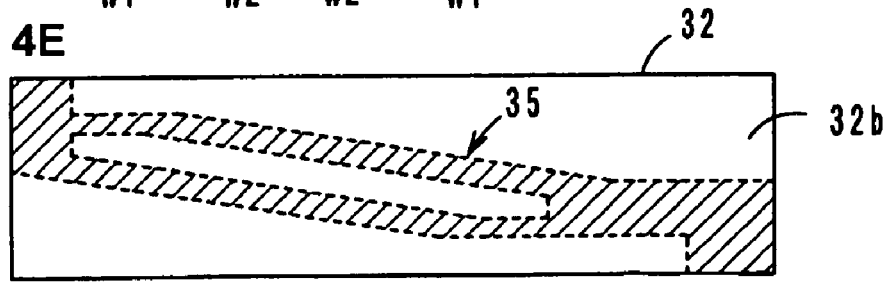

With reference to FIGS. 4A to 4E, hatched portions denote electrodes. Also with reference to FIG. 2, FIG. 4A illustrates an electrode layer of the first central electrode 35 provided at a second layer of the first main surface 32*a*, and FIG. 4B illustrates an electrode layer of the second central electrode 36 provided at a first layer on the first main surface 32*a*. FIG. 4C illustrates electrodes provided on a top surface 32*c* and a bottom surface 32*d* of the ferrite 32. FIG. 4D illustrates an electrode layer of the second central electrode 36 provided at a first layer of the second main surface 32*b*, and FIG. 4E illustrates an electrode layer of the first central electrode 35 provided at a second layer of the second main surface 32*b*.

The permanent magnets 41 are preferably bonded to the main surfaces 32*a* and 32*b*, for example, using an epoxy based adhesive agent 42 (see FIG. 1) so that a magnetic field is applied substantially perpendicular to the main surfaces 32*a* and 32*b*. The permanent magnets 41 thus define the ferrite-magnet assembly 30. The main surfaces of the permanent magnets 41 have the same or substantially the same dimensions as the main surfaces 32*a* and 32*b*, and are mounted with the main surfaces so as to face each other so that the outlines of the main surfaces are substantially aligned.

With reference to FIG. 4A, the first central electrode 35 extends on the first main surface 32*a* of the ferrite 32, rising from the lower right portion of the first main surface 32*a*, and being bifurcated into two lines in the middle portion thereof. The first central electrode 35 is thus inclined at a relatively small angle with respect to the long side of the first main surface 32*a* at the upper left portion of the ferrite 32. The first central electrode 35 rises to the upper left portion of the first main surface 32*a*, and is then routed to the second main surface 32*b* via a relay electrode 35*a* on the top surface 32*c*. As illustrated in FIG. 4E, the first central electrode 35 then extends on the second main surface 32*b*, is bifurcated in two lines in the middle portion thereof such that the extended portion of the first central electrode 35 on the first main surface 32*a* and the extended portion thereof on the second main surface 32*b* overlap each other through the ferrite. One end of the first central electrode 35 is connected to a connection electrode 35*b* provided on the bottom surface 32*d*. The other end of the first central electrode 35 is connected to a connection electrode 35*c* provided on the bottom surface 32*d*. In this manner, the first central electrode 35 is wound around the ferrite 32 by about one turn. The first central electrode 35 crosses the second central electrode 36 to be discussed later with an insulator layer (not shown) interposed therebetween in an electrically insulated manner.

FIGS. 4B and 4D illustrate the second central electrode 36. First, a 0.5-turn second central electrode 36*a* is provided, extending from the lower side to the upper side of the first main surface 32*a* at a relatively large angle with respect to the long side of the first main surface 32*a* such that the second central electrode 36*a* crosses the first central electrode 35. The second central electrode 36*a* is routed via a relay electrode 36*b* on the top surface 32*c* to the second main surface 32*b*, and then a 1-turn second central electrode 36*c* then extends substantially vertically, crossing the first central electrode 35. The lower portion of the 1-turn second central electrode 36*c* is routed to the first main surface 32*a* via a relay electrode 36*d* on the bottom surface 32*d*. An approximately 1.5-turn second central electrode 36*e* extends in parallel or substantially in parallel with the 0.5-turn second central electrode 36*a* on the first main surface 32*a* such that the 1.5-turn second central electrode 36*e* crosses the first central electrode 35. The 1.5-turn second central electrode 36*e* is then routed to the second main surface 32*b* via a relay electrode 36*f* on the top surface 32*c*.

Similarly, a 2-turn second central electrode 36*g*, a relay electrode 36*h*, a 2.5-turn second central electrode 36*i*, a relay electrode 36*j*, a 3-turn second central electrode 36*k*, a relay electrode 36*l*, a 3.5-turn second central electrode 36*m*, a relay electrode 36*n*, and a 4-turn second central electrode 36*o* are successively provided on the main surfaces 32*a* and 32*b* of the ferrite 32. Both ends of the second central electrode 36 are respectively connected to the connection electrode 35*c* and 36*p* provided on the bottom surface 32*d* of the ferrite 32. It is noted that the first central electrode 35 and the second central electrode 36 respectively share the connection electrode 35*c* as the terminal connection electrodes thereof.

In other words, the second central electrode 36 is wound around the ferrite 32 by about four turns. As for the number of turns here, a 0.5 turn is counted when the second central electrode 36 fully transverses one of the main surfaces 32*a* and 32*b*. A crossing angle between the central electrodes 35 and 36 is set as necessary to adjust the input impedance and the insertion loss.

Figure 3:
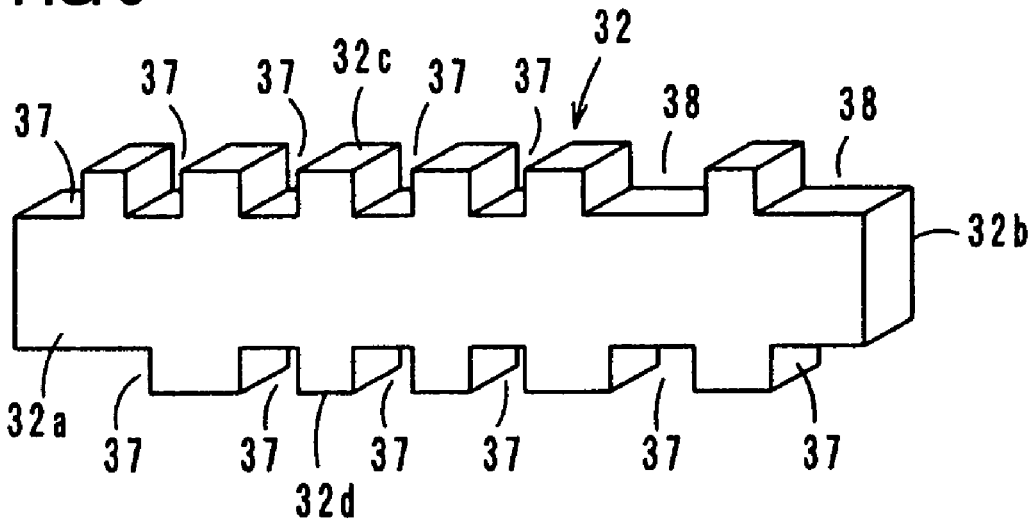
FIG. 3 is a perspective view illustrating the ferrite.

The connection electrodes 35*b*, 35*c*, and 36*p* and the relay electrodes 35*a*, 36*b*, 36*d*, 36*f*, 36*h*, 36*j*, 36*l*, and 36*n* are formed by filling cutout portions 37 (see FIG. 3) on the top and bottom surfaces 32*c* and 32*d* of the ferrite 32 with electrode conductor. Dummy cutout portions 38 are provided on the top surface 32*c* in parallel or substantially in parallel with the electrodes and the dummy electrodes 39*a* and 39*b* are produced. This type of electrodes is formed as described below. Through-holes are preferably formed beforehand in a mother ferrite board, and then filled with electrode conductor. The mother ferrite board is then cut along a line that splits the through-holes. The electrodes may also be a conductor layer deposited on the cutout portions 37 and 38.

The characteristic structure of the present preferred embodiment is that a width dimension W1 of each of the electrode layers 36*a*, 36*c*, 36*m*, and 36*o* wound at the outermost winding of the second central electrode 36 is greater than a width dimension W2 of the electrode layers 36*e*, 36*g*, 36*i*, and 36*k* wound at the inner winding of the second central electrode 36. The operation and advantages of this arrangement will be described later.

YIG ferrite is preferably used for the ferrite 32, for example. The first and second central electrodes 35 and 36 and the electrodes are preferably produced as a thick film or a thin film of silver or a silver-based alloy using printing, transfer printing, or photolithographic printing technique, for example. The insulator layer for the central electrodes 35 and 36 may preferably be a dielectric thick film made of glass or alumina, or a resin film made of polyimide, for example. The insulator layer may also be produced using printing, transfer printing, or photolithographic printing technique, for example.

The permanent magnet 41 is preferably a strontium-based ferrite magnet, a lanthanum-cobalt based ferrite magnet, or a barium-based ferrite magnet, for example. In comparison with a metal magnet defining a conductor, the ferrite magnet defining a dielectric enables a high-frequency magnetic flux to be distributed without loss. Even if the permanent magnet 41 is arranged in close proximity to the central electrodes 35 and 36, electrical characteristics, such as the insertion loss are not degraded. The temperature characteristics of the ferrite 32 at saturation magnetization are similar to the temperature characteristics of magnetic flux density of the permanent magnet 41. When an isolator is constructed by combining the ferrite 32 and the permanent magnet 41, the degree of electrical characteristics of the isolator that depend on temperature is reduced, and thus, this construction is preferable.

Figure 5:
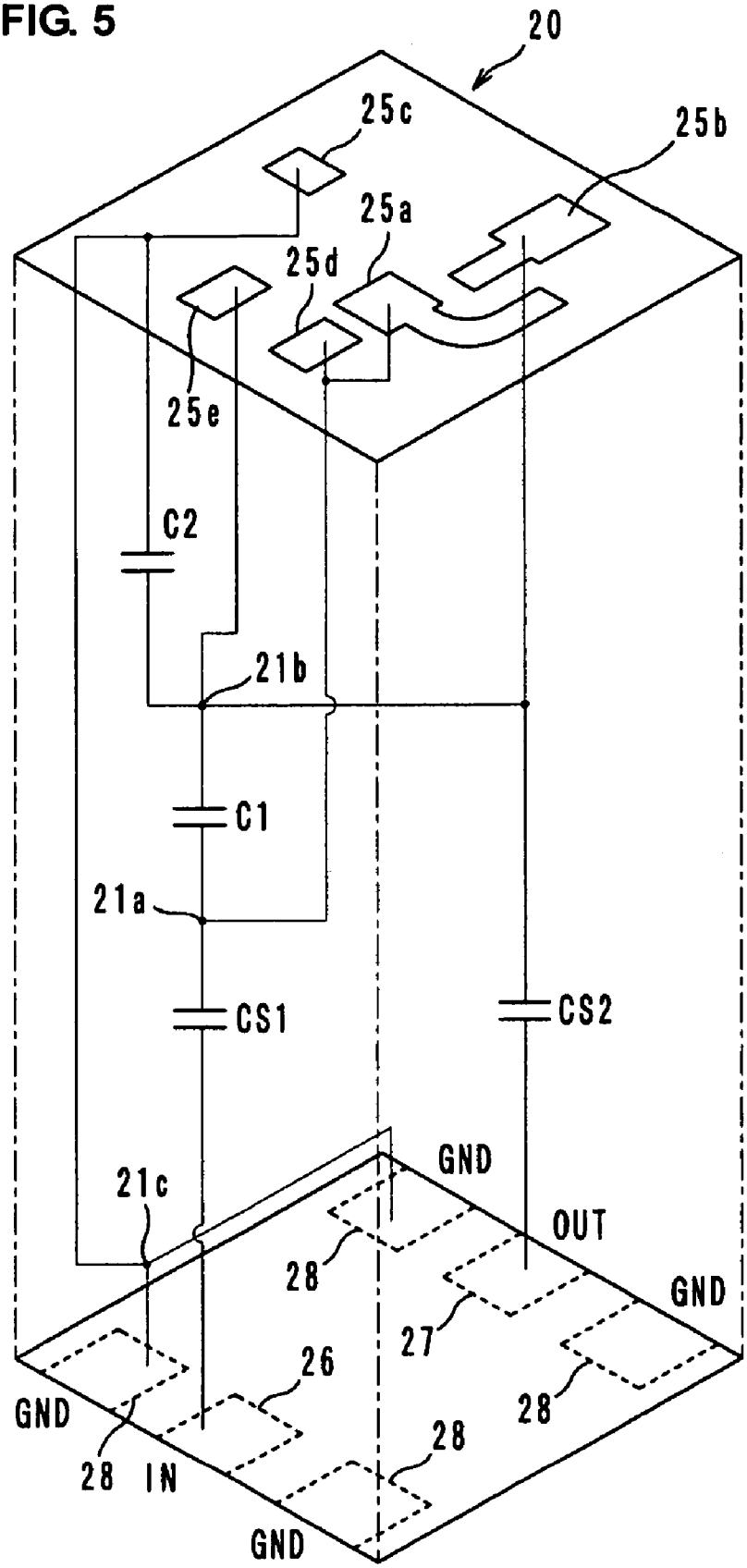
FIG. 5 is a block diagram illustrating a circuit arrangement within a circuit board.

The circuit board 20 is preferably a laminated board that is produced by forming and laminating predetermined electrodes on a plurality of dielectric sheets, and then sintering the laminate, for example. Referring to FIG. 5, the circuit board 20 includes matching capacitors C1, C2, CS1, and CS2 therein, and a terminal resistor R (the chip resistor 45 see FIG. 1) is attached to the circuit board 20. Terminal electrodes 25*a*-25*e* are provided on the top surface of the circuit board 20 and terminal electrodes 26, 27, and 28 for external connection are provided on the bottom surface of the circuit board 20.

Figure 6:
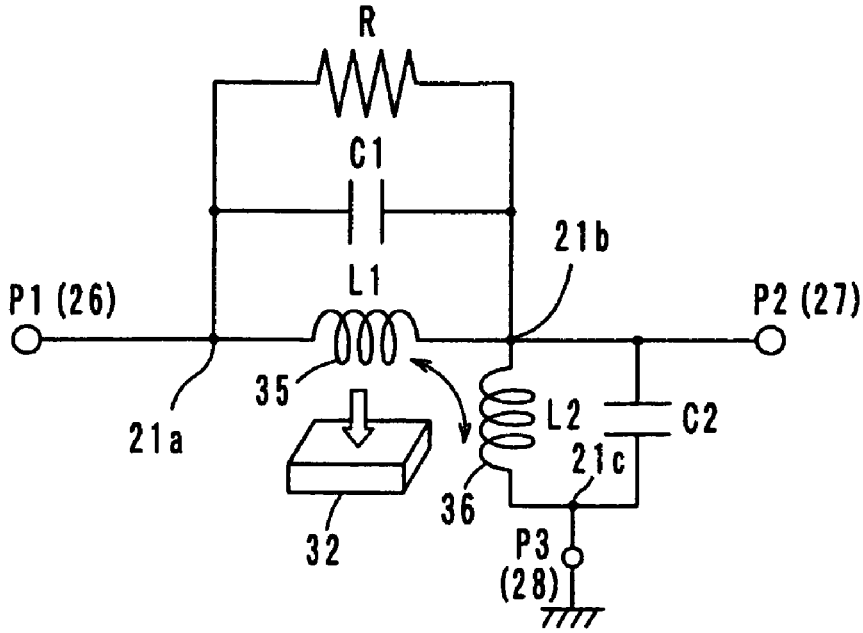
FIG. 6 is an equivalent circuit diagram illustrating a first circuit example of the 2-port type isolator.
Figure 7:
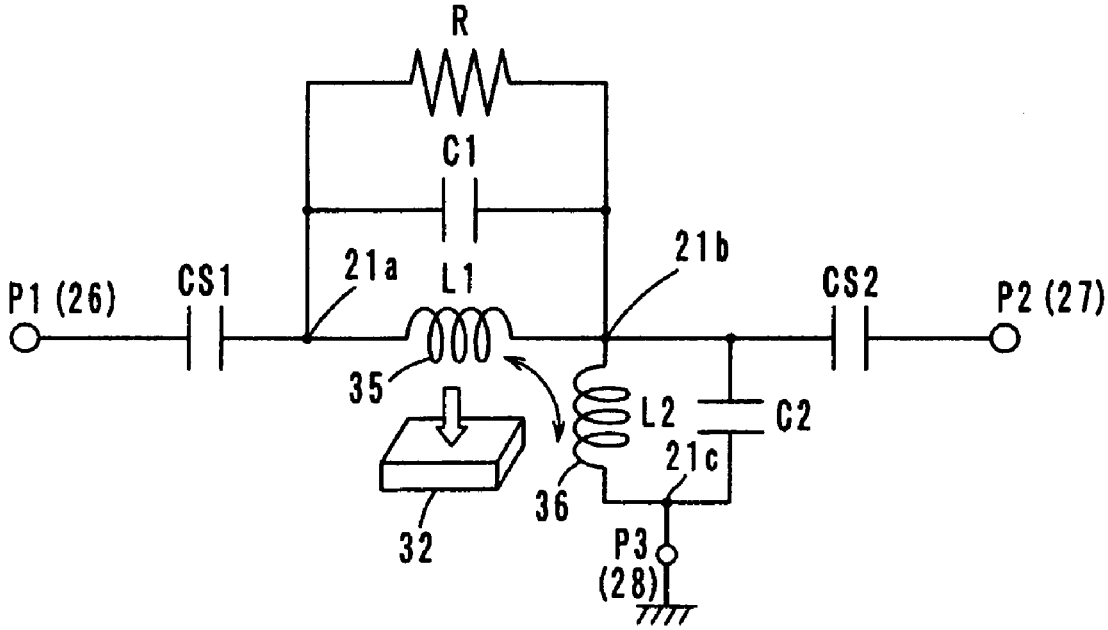
FIG. 7 is an equivalent circuit diagram illustrating a second circuit example of the 2-port type isolator.

A connection between these matching circuit elements and the first and second central electrodes 35 and 36 is described with reference to equivalent circuits illustrated in FIGS. 5, 6, and 7. The equivalent circuit illustrated in FIG. 6 is a first basic circuit example in the nonreciprocal circuit device (the 2-port type isolator) in accordance with a preferred embodiment of the present invention. The equivalent circuit illustrated in FIG. 7 is a second circuit example. FIG. 5 illustrates a structure of the second circuit example illustrated in FIG. 7.

More specifically, the terminal electrode 26 for external connection provided on the bottom surface of the circuit board 20 defines an input port P1, the terminal electrode 26 is connected to a junction point 21*a* of the matching capacitor C1 and a terminal resistor R (terminal electrode 25*d*) via the matching capacitor CS1. The junction point 21*a* is connected to one end of the first central electrode 35 via a terminal electrode 25*a* provided on the top surface of the circuit board 20 and the connection electrode 35*b* provided on the bottom surface 32*d* of the ferrite 32.

The other end of the second central electrode 36 and one end of the second central electrode 36 are connected to the terminal resistor R (terminal electrode 25*e*) and the capacitors C1 and C2 via the connection electrode 35*c* provided on the bottom surface 32*d* of the ferrite 32 and the terminal electrode 25*b* provided on the circuit board 20.

The terminal electrode 27 for external connection provided on the bottom surface of the circuit board 20 defines the output port P2. The electrode 27 is connected to a junction point 21*b* of the capacitors C1 and C2 and the terminal resistor R (terminal electrode 25*e*) via the matching capacitor CS2.

The other end of the second central electrode 36 is connected, via the connection electrode 36*p* provided on the bottom surface 32*d* of the ferrite 32 and the terminal electrode 25*c* provided on the top surface of the circuit board 20, to a junction point 21*c* between the capacitor C2 and the terminal electrode 28 for external connection located on the bottom surface of the circuit board 20. The terminal electrode 28 for external connection defines the ground port P3.

The ferrite-magnet assembly 30 is mounted on the circuit board 20. The electrodes on the bottom surface 32*d* of the ferrite 32 are preferably soldered to and form unitary bodies with the terminal electrodes 25*a*, 25*b*, and 25*c* on the circuit board 20 with solder 46 through a reflow soldering operation, for example. The underside of the permanent magnets 41 are preferably bonded onto the circuit board 20 into a unitary body using an adhesive agent, for example. The chip resistor 45 is connected to the terminal electrodes 25*d* and 25*e* via solder 46.

The electrodes are preferably connected to the respective electrodes on the circuit board 20 through the reflow soldering operation, for example. Instead of the reflow soldering operation, the electrodes may be connected using solder bumps, gold bumps, conductive paste, or a conductive adhesive agent, for example.

A thermosetting one-liquid or two-liquid epoxy based adhesive agent may be appropriate for the adhesive agent for bonding the permanent magnet 41 to the circuit board 20. More specifically, a combination of the soldering operation and the bonding operation to bond the ferrite-magnet assembly 30 to the circuit board 20 results in a reliable bond.

A sintered compound of glass and alumina or another dielectric material is preferably used for the circuit board 20 or a complex board composed of a resin, glass and a dielectric material may preferably be used for the circuit board 20, for example. Internal and external electrodes may preferably be made of a thick film made of silver or a silver-based alloy, a thick film of copper, or a copper foil, for example.

In the 2-port type isolator having the above-described structure, the one end of the first central electrode 35 is connected to the input port P1, the other end thereof is connected to the output port P2, the one end of the second central electrode 36 is connected to the output port P2, and the other end thereof is connected to the ground port P3. In comparison with the known 2-port type isolator, the lumped constant type isolator has a low insertion loss. The known 2-port type isolator refers to a type in which one end of a first central electrode is connected to an input port, the other end thereof is connected to a ground port, one end of a second central electrode is connected to an output port, and the other end thereof is connected to the ground port.

Furthermore, during operation, a large high-frequency current flows through the second central electrode 36 while almost no high-frequency current flows through the first central electrode 35. The direction of the high-frequency magnetic field caused by the first central electrode 35 and the second central electrode 36 is determined by the layout of the second central electrode 36. With the direction of the high-frequency magnetic field determined, the ferrite 32 is arranged not to interfere with the magnetic path. Thus, a remedial step to reduce the insertion loss is easily performed.

Since the first central electrode 35 and the second central electrode 36 are defined by the electrode layers on the main surfaces 32*a* and 32*b* of the ferrite 32, the central electrodes 35 and 36 are miniaturized and have accurate dimensions. In particular, as illustrated in FIG. 4, the width dimension W1 of each of the electrode layers 36*a*, 36*c*, 36*m*, and 36*o* wound at the outermost winding of the second central electrode 36 is greater than the width dimension W2 of the electrode layers 36*e*, 36*g*, 36*i*, and 36*k* wound at the inner winding of the second central electrode 36. With this arrangement, a direct-current component of the second central electrode 36 is decreased, the Q thereof is increased, and the insertion loss thereof is decreased.

If the central electrodes 35 and 36 are made of a thick film or a thin film, a highly accurate design can be provided. However, a print smudge of the electrode layer, a solvent remnant in a photolithographic process, and diffusion into an insulator are unavoidable. With a smudge approximately as large as the film thickness, overetching and underetching are caused. A low loss is typically achieved by setting the electrode thickness to be several times as large as the skin depth of the high frequency. In microwave bands, the electrode thickness is preferably set to be in a range of about 7 μm to about 20 μm, for example. In this case, an insulation gap between the electrode layers must be a total of about 34 μm to about 70 μm taking into consideration a smudge margin from left and right of about 7 μm to about 20 μm, and an insulation width at the approximate center of about 20 μm to about 30 μm, for example.

In accordance with the present preferred embodiment, the width dimension W1 of each of the outermost electrode layers 36*a*, 36*c*, 36*m*, and 36*o* typically having a wide space margin is set to be increased. The gap between the electrode layers is thus assured, the Q is increased, and the insertion loss is decreased.

Figure 8:
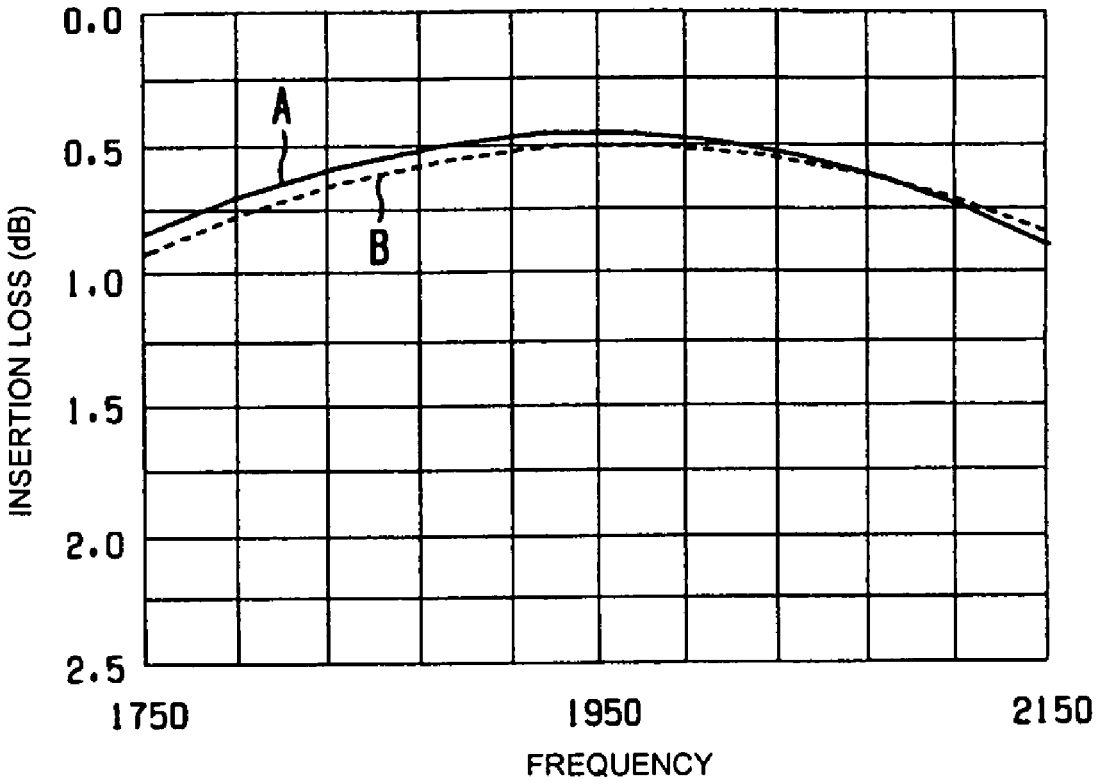
FIG. 8 is a plot of insertion loss characteristics, wherein a curve A represents a preferred embodiment of the present invention and a curve B represents a comparative example.
Figure 9A:
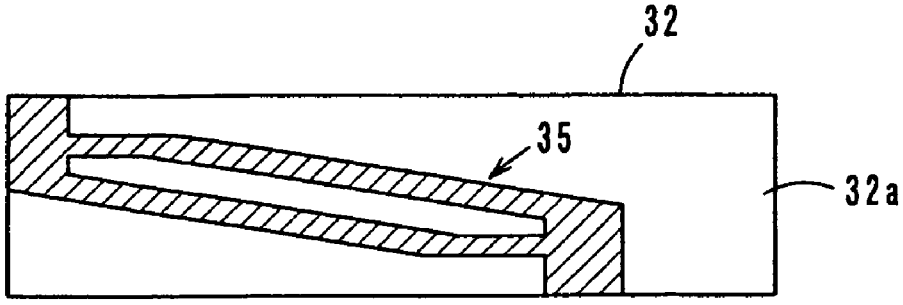
FIGS. 9A-9E illustrates a central electrode of the comparative example.
Figure 9B:
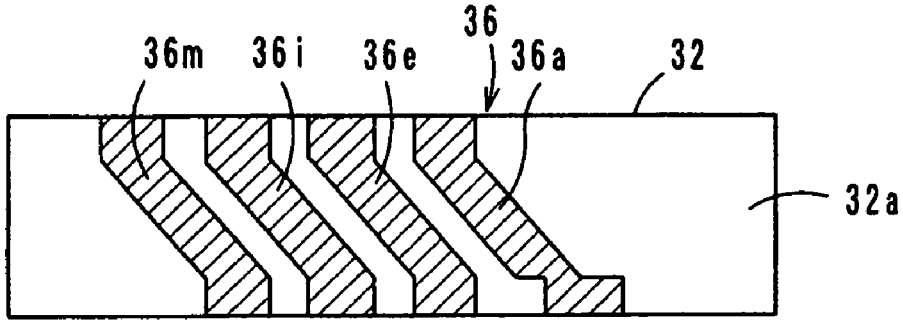
Figure 9C:
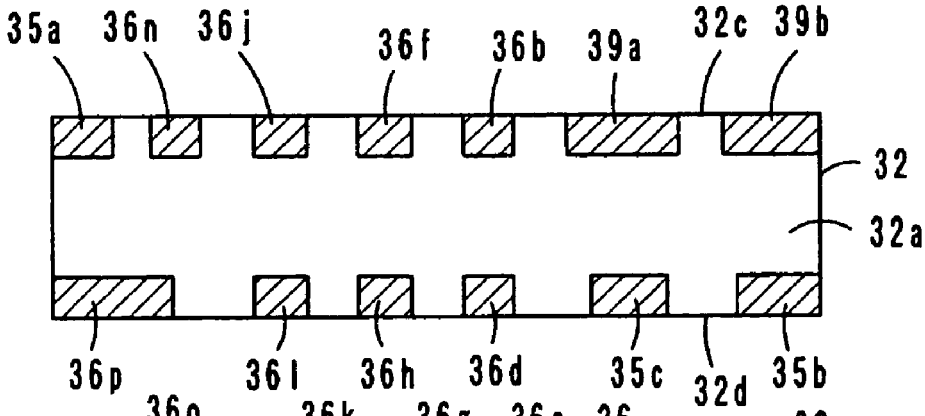
Figure 9D:
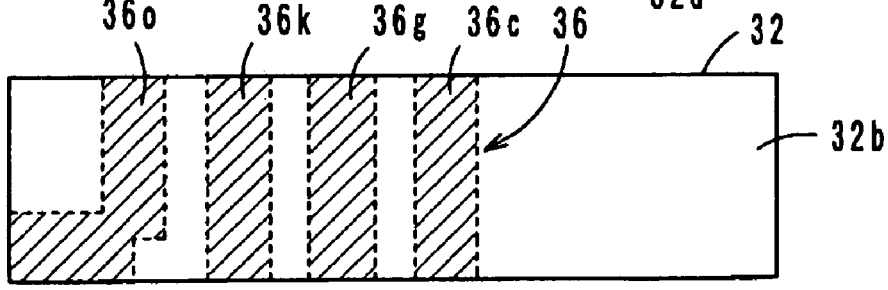
Figure 9E:
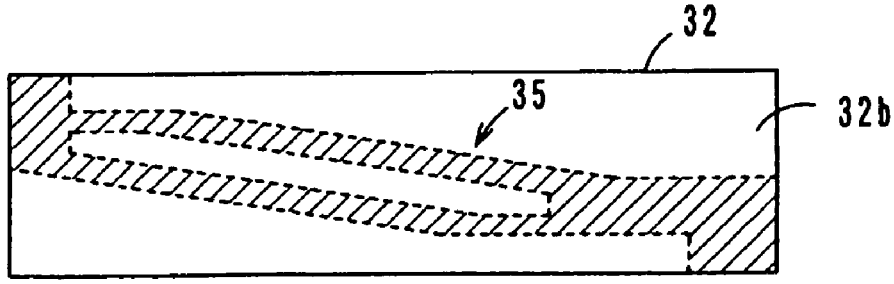

A curve A in FIG. 8 represents insertion loss characteristics in the present preferred embodiment. A curve B represents insertion loss characteristics of a comparative example in which the electrode layers of the second central electrode 36 are all set to have the same dimension W2. FIGS. 9A-9E illustrates the shapes of the first central electrode 35 and the second central electrode 36 of the comparative example.

The ferrite-magnet assembly 30 is mechanically reliable because the ferrite 32 and a pair of permanent magnets 41 are bonded together into a unitary body by an adhesive agent 42. The ferrite-magnet assembly 30 is a robust isolator that is not deformed or damaged by vibrations and shocks. Such an isolator is appropriate for a mobile communication device.

In accordance with the present preferred embodiment, the circuit board 20 is a multi-layered dielectric board. Thus, the circuit board 20 may include a circuit element such as a capacitor. Thus, a miniaturized and flat isolator is produced. Since the circuit elements are connected within the board, the reliability of the circuit board is outstanding. The resistor R may preferably be defined by a resistor film and included in the circuit board 20. The circuit board 20 is not necessarily a multilayer circuit board. The circuit board 20 may be single-layered. If the circuit board 20 is single-layered, a matching capacitor may be attached as a chip type capacitor.

The nonreciprocal circuit device of the present invention is not limited to the above-described preferred embodiments, and may be modified in a variety of configurations within the scope of the present invention.

For example, if the N pole and the S pole of the permanent magnet 41 are inverted, the input port P1 and the output port P2 are reversed. The ferrite 32 is substantially vertically arranged in the above-described preferred embodiment. Alternatively, the ferrite 32 may be arranged in a substantially horizontal position (with the main surfaces 32*a* and 32*b* of the ferrite 32 arranged in parallel or substantially in parallel with the surface of the circuit board 20).

The first central electrode 35 and the second central electrode 36 may have a variety of shapes. For example, in the above-described preferred embodiment, the first central electrode 35 is bifurcated on the main surfaces 32*a* and 32*b*. Alternatively, the first central electrode 35 may not be bifurcated. It is sufficient if the second central electrode 36 is wound by at least about three turns.

The first central electrode 35 and the second central electrode 36 may be provided not only on the main surfaces 32*a* and 32*b* but also in an inner layer electrode in a bonded ferrite 32.

As described above, the present invention is useful in a nonreciprocal circuit device, such as an isolator or a circulator, and is particularly useful because the insertion loss is reduced.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A nonreciprocal circuit device comprising:

a permanent magnet;

a ferrite to which the permanent magnet applies a direct-current magnetic field;

a first central electrode arranged on the ferrite and having one end thereof electrically connected to an input port and another end thereof electrically connected to an output port;

a second central electrode arranged on the ferrite, crossing the first central electrode so as to be electrically insulated from the first central electrode, and having one end thereof electrically connected to the output port and the other end thereof electrically connected to a ground port;

a first matching capacitor electrically connected between the input port and the output port;

a resistor electrically connected between the input port and the output port;

a second matching capacitor electrically connected between the output port and the ground port; and a circuit board having a terminal electrode on the surface thereof; wherein the ferrite has a substantially rectangular parallelepiped shape;

the first central electrode includes electrode layers provided on a pair of main surfaces of the ferrite and connected to each other by an electrode arranged on a side surface of the ferrite continuous to the main surfaces of the ferrite; and the second central electrode includes electrode layers provided on the pair of main surfaces of the ferrite and connected to each other by an electrode arranged on the side surface of the ferrite that is continuous with the main surfaces of the ferrite, the second electrode wound at least about three turns around the ferrite, a width dimension of the electrode layer wound as the outermost winding of the second central electrode being greater than a width dimension of the electrode layer wound as an inner winding of the second central electrode.

2. The nonreciprocal circuit device according to claim 1, wherein the electrode layer wound as the outermost winding of the second central electrode expands outwardly.

3. The nonreciprocal circuit device according to claim 1, wherein the circuit board includes at least the first matching capacitor and the second matching capacitor.

4. The nonreciprocal circuit device according to claim 1, wherein the main surfaces of the ferrite are arranged to be perpendicular or substantially perpendicular to the surface of the circuit board.

5. The nonreciprocal circuit device according to claim 4, wherein a ferrite-magnet assembly includes a pair of magnets sandwiching the ferrite on the main surfaces thereof.

* * * * *